US007520785B2

(12) United States Patent
Aihara

(10) Patent No.: US 7,520,785 B2
(45) Date of Patent: Apr. 21, 2009

(54) CONNECTOR

(75) Inventor: Tetsuya Aihara, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/030,249

(22) Filed: Feb. 13, 2008

(65) Prior Publication Data

US 2008/0194136 A1 Aug. 14, 2008

(30) Foreign Application Priority Data

Feb. 14, 2007 (JP) ..... 2007-033681

(51) Int. Cl.
*H01R 13/64* (2006.01)

(52) U.S. Cl. ..... 439/680

(58) Field of Classification Search ..... 439/74, 439/345, 660, 680, 607, 83, 701, 140
See application file for complete search history.

(56) References Cited

U.S. PATENT DOCUMENTS 5,915,996 A 6/1999 Kitamura
5,989,040 A 11/1999 Nishimatsu
6,875,027 B2 * 4/2005 Ye et al. ..... 439/74
7,118,417 B2 10/2006 Aihara et al.
7,134,910 B2 11/2006 Nakano et al.
7,341,494 B2 * 3/2008 Wang ..... 439/680
7,371,129 B2 * 5/2008 Mongold ..... 439/701
2001/0023143 A1 9/2001 Middlehurst et al.

FOREIGN PATENT DOCUMENTS

GB 2050078 12/1980

* cited by examiner

*Primary Examiner*—Edwin A. Leon
(74) *Attorney, Agent, or Firm*—Gerald E. Hespos; Anthony J. Casella

(57) ABSTRACT

With two connectors (10, 20) properly connected, engaging projections (28) projecting from wall surfaces of lower receiving grooves (27S) are inserted below engageable portions (18) provided on lower reinforcing ribs (17S) and these engaging projections (28) can be held in contact with the engageable portions (18) from below. Thus, if an upward force acts on the female connector (20), the engaging projections (28) contact the engageable portions (18) and this force is borne by the lower reinforcing ribs (17S). In other words, since the upward force acting on the female connector (20) is borne by both upper and lower walls (13U, 13S) of a receptacle (13), the upper wall (13U) can be made thinner as compared to the case where this force acts only on the upper wall (13U). As a result, a board connector (C1) can be thinned further.

9 Claims, 7 Drawing Sheets

CONNECTOR

BACKGROUND OF THE INVENTION

1. Field of the Invention

The invention relates to a connector assembly with a first connector to be mounted to an electric or electronic device, such as a circuit board, and a second connector to be connected with the first connector.

2. Description of the Related Art

U.S. Pat. No. 7,134,910 discloses a board connector assembly with first and second connectors. The first connector includes a tubular receptacle and is mountable on a circuit board. The second connector is fittable into the receptacle.

An upward force can act on the connector assembly, for example, when a wire drawn out from the second connector is bent and pulled up away from the circuit board when the two connectors are connected properly. In this situation, the second connector contacts the upper wall of the receptacle and exerts an upward force on the upper wall of the receptacle. Thus, the upper wall must have a specified strength to avoid being cracked or damaged.

On the other hand, there has been a demand for thinning receptacles to provide thinner circuit boards. However, the upper wall cannot be thinned very much even if reinforcing ribs are formed on the upper. Therefore further ingenuity has been hoped.

The present invention was developed in view of the above situation, and an object thereof is to allow a connector to be further thinned.

SUMMARY OF THE INVENTION

The invention relates to a connector assembly that includes first and second connectors. The first connector includes a receptacle and is mountable to an electric or electronic device, such as a circuit board. The second connector is fittable into the receptacle. The receptacle of the first connector has a lower wall that faces the electric or electronic device. The lower wall of the receptacle of the first connector is formed with at least one reinforcing rib that extends substantially along a connecting direction of the two connectors for reinforcing the wall. A receiving groove is formed in the second connector for receiving the reinforcing rib upon connecting the two connectors. At least one engageable portion projects from the reinforcing rib and faces the lower wall at a position spaced from the lower wall. At least one engaging projection projects into the receiving groove of the second connector and can be inserted between the engageable portion and the lower wall of the first connector. The engaging projection contacts the engageable portion if a force urges the second connector away from the electric or electronic device, and this force is borne by the reinforcing rib. In other words, an upward force on the second connector is borne by both the upper and lower walls of the receptacle. As a result, the upper wall can be made thinner as compared to the case where this force acts only on the upper wall, and accordingly the connector can be even thinner.

A vertical clearance between an upper wall of the receptacle and the upper surface of the second connector preferably is substantially equal to the vertical clearance between the engageable portion and the engaging projection. Thus, a force that urges the second connector away from the electric or electronic device will cause the engaging projection to contact the engageable portion at the same time that the second connector contacts the upper wall of the receptacle. Accordingly, the upward force is borne simultaneously by the upper and lower walls, and the thicknesses of the upper and lower walls are determined by this distribution of forces. Therefore, the upper and lower walls can be made even thinner to thin the connector.

The engageable portion and the engaging projection project at an angle to the connecting direction of the connectors.

The engageable portion and the engaging projection preferably are formed over substantially the entire lengths of the reinforcing rib and the receiving groove in the connecting direction of the connectors. Thus, an upward force on the second connector is distributed over the entire length of the reinforcing rib. Accordingly, the lower wall can be made thinner as compared to the case where this force concentrates on a specific part.

An engageable surface of the engageable portion substantially facing the engaging projection preferably is inclined to approach the lower wall towards the projecting end of the engageable portion. Thus, the engageable surface is unlikely to disengage laterally from the engaging projection and a state where the upward force is borne by the lower wall is maintained reliably.

The projecting end of the engaging projection preferably is pointed towards an engageable surface of the engageable portion. Thus, the engaging projection contacts the engageable surface and the projecting end thereof bites in the engageable surface if a large upward force acts on the second connector away from the electric or electronic device. Accordingly, the engaging projection and the engageable portion are unlikely disengage from each other, and the state where the upward force is borne by the lower wall is maintained reliably.

The engageable portion may be is provided near the front end of the reinforcing rib in the connecting direction with the second connector, and the engaging projection may be provided near the rear end of the receiving groove in the connecting direction with the first connector. Thus, the engageable portion and the engaging projection are engaged towards a final stage of the connecting operation of the two connectors. Accordingly, there is no likelihood of increasing resistance due to the contact of the engaging projection and the engageable portion from the initial stage to the final stage of the connecting operation of the two connectors. As a result, a force required to connect the two connectors is suppressed to about the same level as in the case where neither the engaging projection nor the engageable portion is provided.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A board connector assembly in accordance with a first embodiment of the invention is illustrated in FIGS. 1 to 4. The connector assembly is identified generally by C1 in FIG. 1 and includes a male connector 10 that is mountable on a circuit board K and a female connector 20 connectable along a connecting direction CD with the male connector 10. In the following description, ends of the connectors 10, 20 that are to be connected are referred to as front ends and reference is made to FIG. 1 concerning vertical direction.

Figure 1:
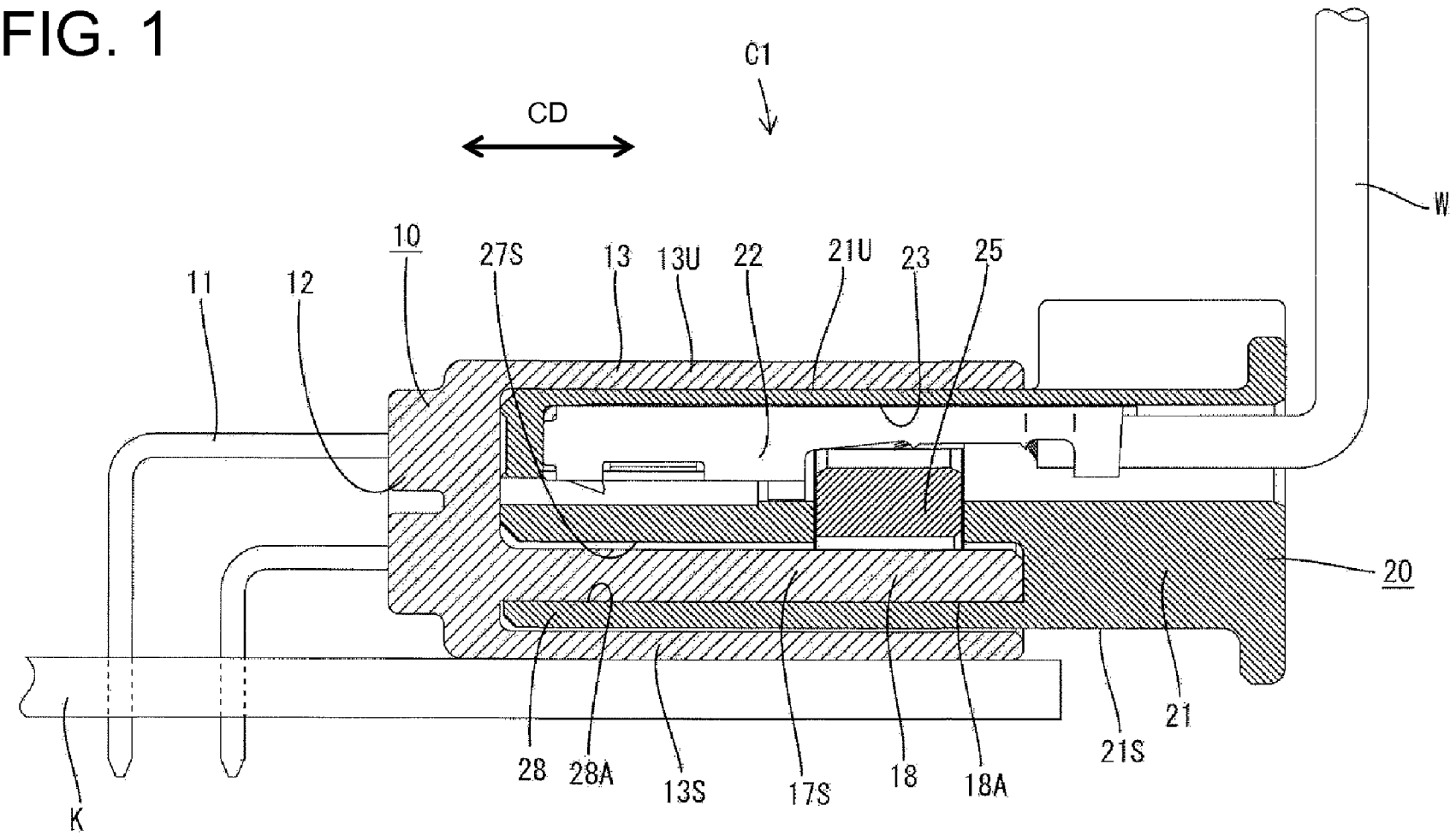
FIG. 1 is a side view in section of a board connector according to a first embodiment.
Figure 2:
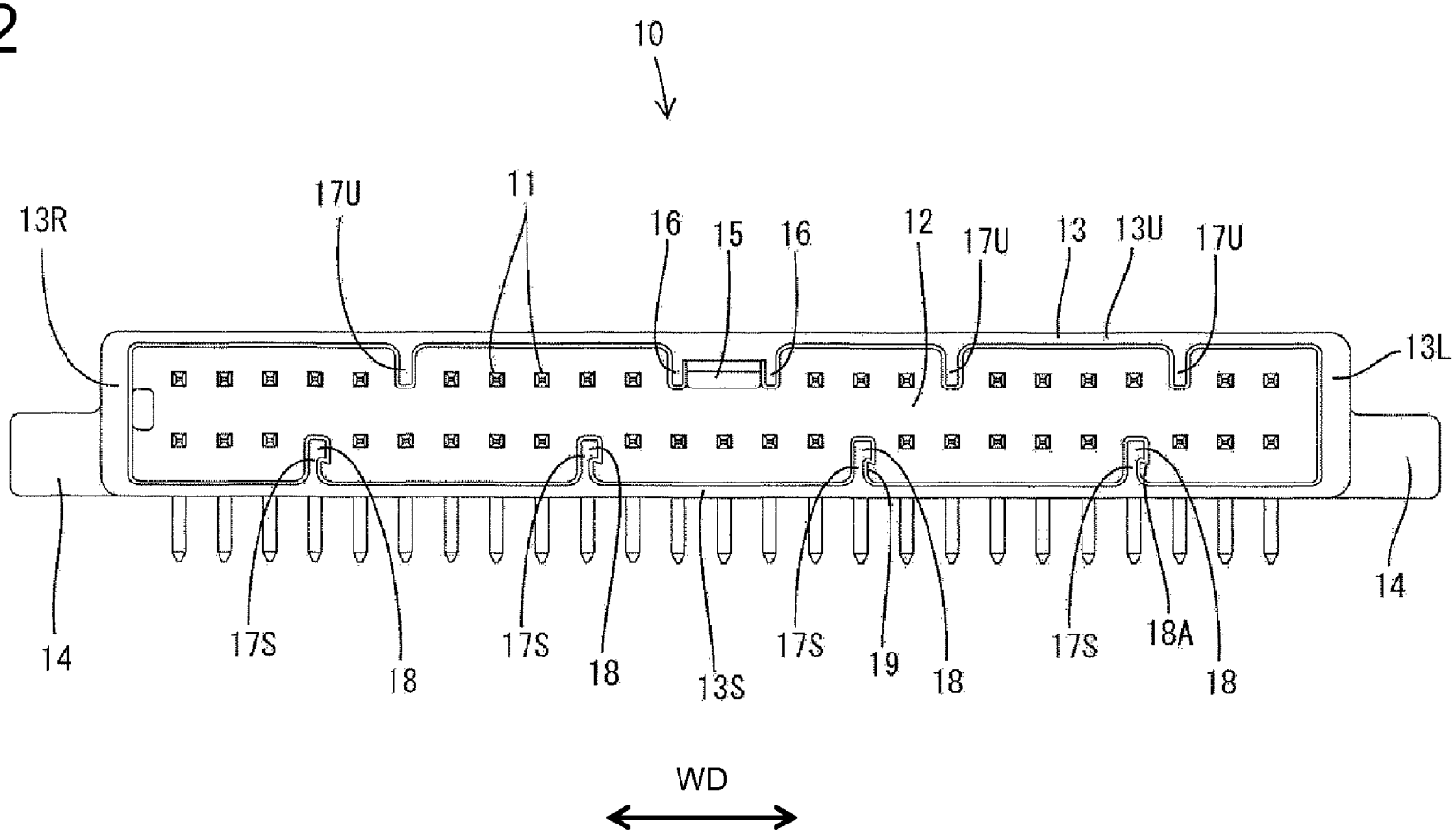
FIG. 2 is a front view of a male connector.

The male connector 10 is made e.g. of synthetic resin, and includes a terminal holding portion 12 for holding male terminals 11. A receptacle 13 projects forward from the periphery of the terminal holding portion 12 and surrounds male terminals 11, as shown in FIG. 2.

The male terminals 11 are arranged substantially side by side in a width direction WD at upper and lower stages in the terminal holding portion 12. Each male terminal 11 is formed by stamping out or cutting a conductive metal plate into a specified shape and bending, folding or embossing the stamped-out or cut piece. The male terminals 11 penetrate the terminal holding portion 12 in forward and backward directions and are bent down at substantially right angles at positions rearward of the terminal holding portion 12 to define substantially L-shapes. A part of each male terminal 11 projecting forward from the terminal holding portion 12 is electrically connectable with a female terminal 22 in the female connector 20, whereas a part extending back from the terminal holding portion 12 has the end inserted into a through hole in the circuit board K for connection with a conduction path (not shown) of the circuit board K.

The receptacle 13 is a wide rectangular tube with upper and lower walls 13U, 13S, left and right walls 13L, 13R and an open front end for receiving the female connector 20. Mounting portions 14 project from the left and right walls 13L, 13R of this receptacle 13, and can receive screws or rivets for fixing the male connector 10 to the circuit board K.

A lock projection 15 projects down and into the receptacle 13 at a substantially widthwise center position of the upper wall 13U of the receptacle 13 for engaging a lock arm 26 of the female connector 20. Two guides 16 project down at opposite sides of the lock projection 15 and extend in substantially forward and backward directions. The lock arm 26 is inserted between the two guides 16 for guiding a connecting operation of the two connectors 10, 20.

Parts of the upper and lower walls 13U, 13S of the receptacle 13 are thinner than the left and right walls 13L, 13R to achieve a shorter height and to thin the board connector C1. The upper and lower walls 13L, 13R are formed unitarily with upper and lower reinforcing ribs 17U and 17S extending forward and backward along the connecting direction CD of the connectors 10, 20.

Three upper reinforcing ribs 17U project down from the upper wall 13U and into the receptacle 13. One upper reinforcing rib 17U is at a position substantially bisecting a part of the upper wall 13U to the right (left in FIG. 2) of the lock projection 15 and two upper reinforcing ribs 17U are at a part of the upper wall 13U to the left (right in FIG. 2) of the lock projection 15. In other words, the upper reinforcing ribs 17U are arranged asymmetrically with respect to a transverse widthwise direction WD that is substantially normal to the connecting direction CD. All of the upper reinforcing ribs 17U are shaped identically and are dimensioned and arranged between adjacent male terminals 11. Bottom ends of the upper reinforcing ribs 17U reach the height of the male terminals 11 at the upper stage to partition the adjacent male terminals 11.

Four lower reinforcing ribs 17S project up from the bottom wall 13S of the receptacle 13. Two pairs of lower reinforcing ribs 17S are provided at positions transversely symmetrical with respect to the widthwise center position of the receptacle 13. Specifically, two of the lower reinforcing ribs 17S are arranged near the left and right walls 13L, 13R of the receptacle 13, and the remaining two lower reinforcing ribs 17S are provided at positions trisecting a part of the lower wall 13S between the lower reinforcing ribs 17S at the opposite ends. The lower reinforcing ribs 17S are at positions displaced or offset from the upper reinforcing ribs 17U in the width direction WD. All of the lower reinforcing ribs 17S are identical and are arranged between the adjacent male terminals 11 similar to the upper reinforcing ribs 17U. The upper ends of the lower reinforcing ribs 17S reach the height of the male terminals 11 arranged at the lower stage to partition the adjacent male terminals 11. It should be noted that the shape of the lower reinforcing ribs 17S is described in detail later.

Figure 3:
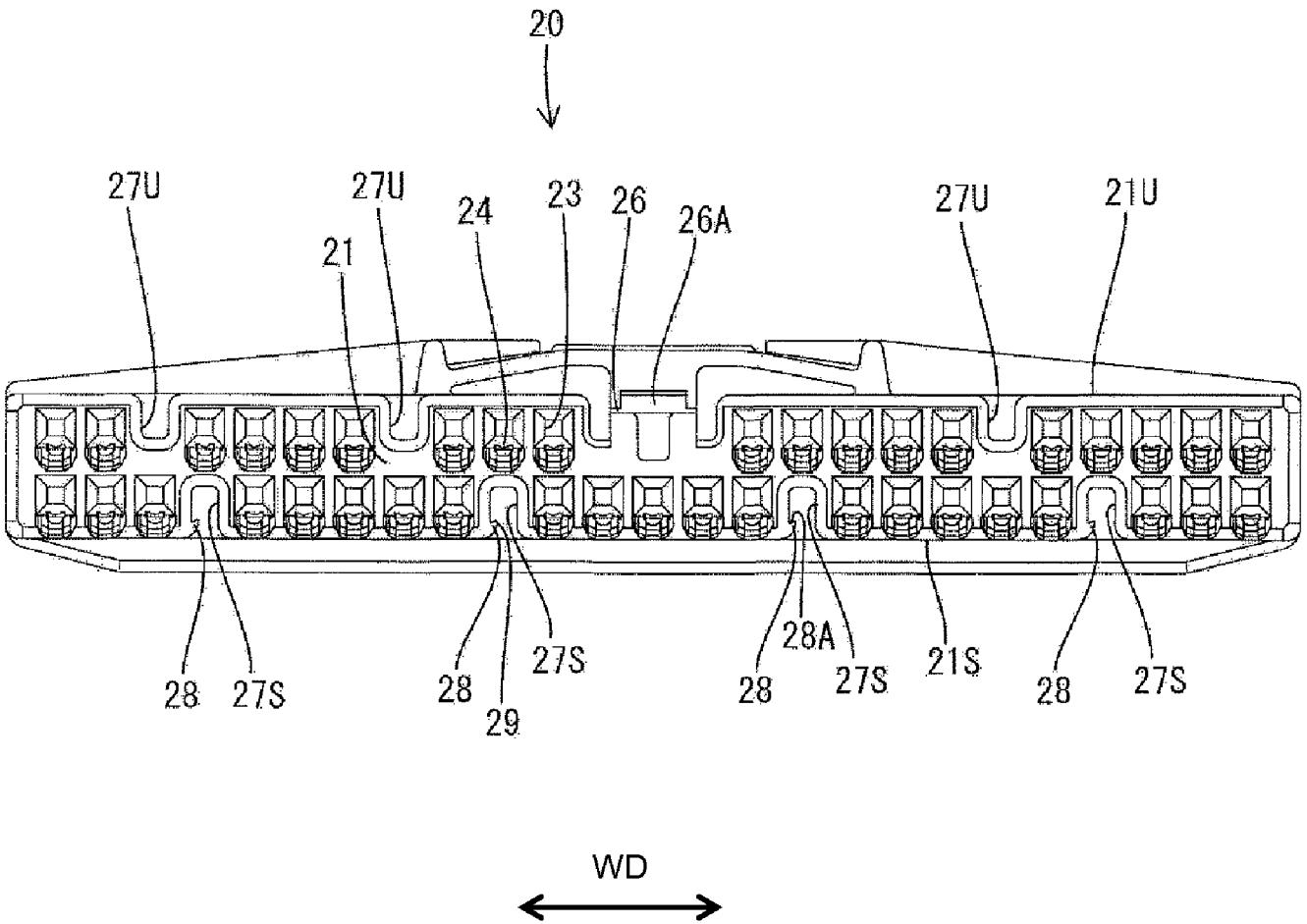
FIG. 3 is a front view of a female connector.
Figure 4:
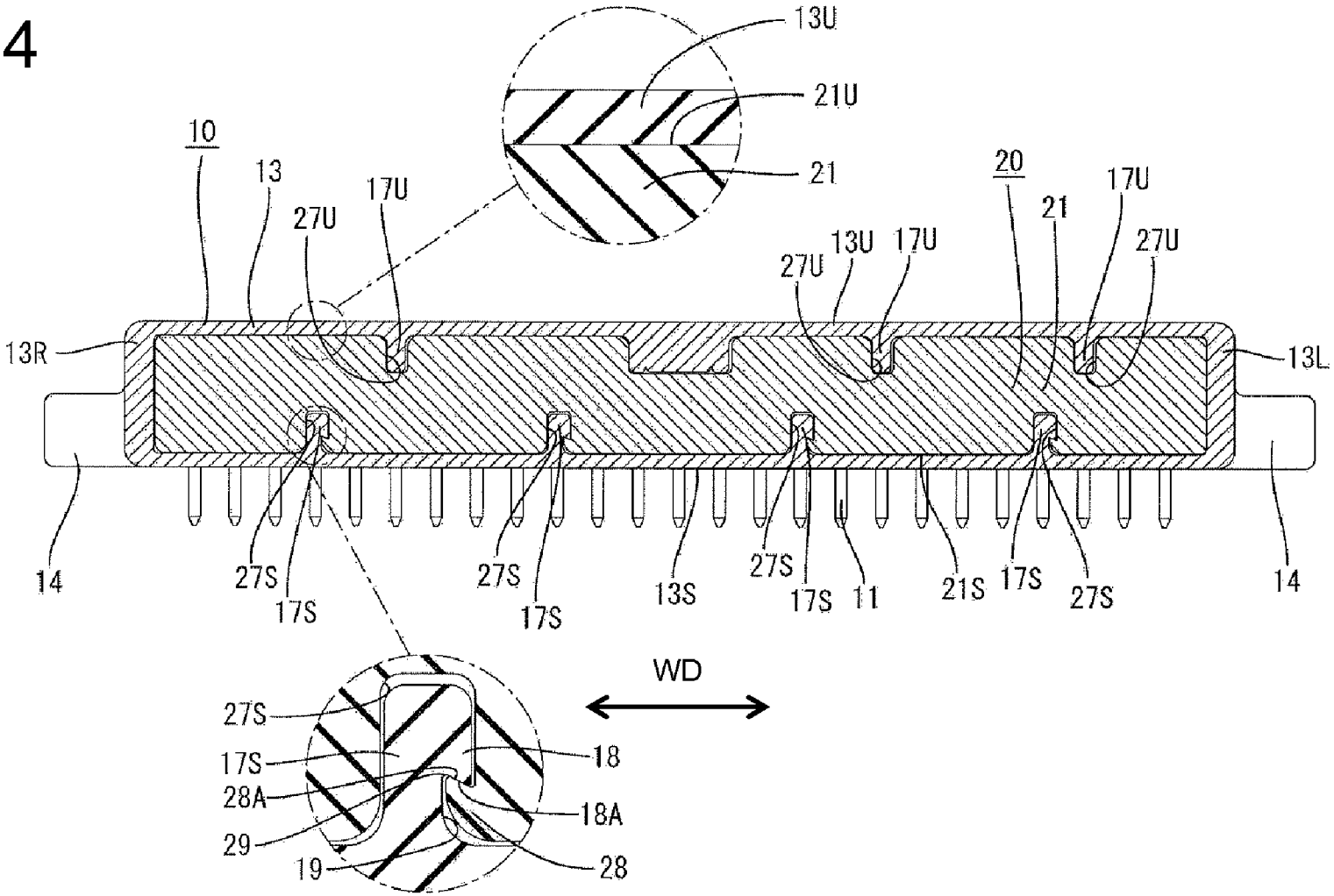
FIG. 4 is a front view in section showing a state where the two connectors are connected.

The female connector 20 includes a housing 21 made e.g. of synthetic resin and in the form of a wide block (see FIG. 3). Cavities 23 are arranged side by side in the width direction WD at upper and lower stages in the housing 21 and the female terminals 22 connected with ends of wires W are insertable into the cavities 23 from behind. The female terminals 22 are retained in the cavities 23 by locks 24 formed on the surrounding walls of the cavities 23 and a retainer mounted in the housing 21 (see FIG. 1).

A lock arm 26 is provided substantially the widthwise center of an upper surface 21U of the housing 21 and is resiliently deformable up and down in a direction intersecting the connecting direction CD. A locking projection 26A projects from the upper surface of the lock arm 26 is engageable with the lock projection 15 in the receptacle 13 to hold the connectors 10, 20 together.

Upper and lower receiving grooves 27U, 27S are formed respectively in the upper and lower surfaces of the housing 21 at positions aligned with walls between adjacent cavities 23. The receiving grooves 27U, 27S have open front ends and extend forward and backward along the connecting direction CD of the two connectors 10, 20. The shapes of the upper and lower receiving grooves 27U, 27S, when viewed from the front, are substantially identical to the cross-sectional shapes of the upper and lower reinforcing ribs 17U, 17S of the male connector 10. Additionally, the upper and lower receiving grooves 27U, 27S are disposed to align with the upper and lower reinforcing ribs 17U, 17S of the male connector 10 upon connecting the two connectors 10, 20. Thus, the respective upper and lower reinforcing ribs 17U, 17S are insertable into the receiving grooves 27U, 27S.

An engaging portion 18 is formed at the upper part of each lower reinforcing rib 17S. Each engaging projection 18 projects laterally (rightward in FIG. 2) substantially normal to the connecting direction CD of the two connectors 10, 20 at a position spaced up a specified distance from the lower wall 13S. Thus, each lower reinforcing rib 17S is substantially L-shaped when viewed from the front. Lower parts of the lower reinforcing ribs 17S are narrower than upper parts thereof by the width of the engageable portions 18, and recesses 19 are defined below the engageable portions 18.

The engageable portions 18 are formed over substantially the entire lengths of the lower reinforcing ribs 17S in forward and backward directions. Lower engageable surfaces 18A are formed on the engageable portions 18 and substantially face the lower wall 13S. The engageable surfaces 18A are inclined to approach the lower wall 13S towards the projecting ends of the engageable portions 18 (inclined down to the right in FIG. 2).

An engaging projection 28 projects laterally from a lower side surface of each lower receiving groove 27S, and extends over substantially the entire length of the lower receiving groove 27S in forward and backward directions. The engaging projection 28 is insertable into the recess 19 below the engageable portion 18 and can be held in contact with the engageable portion 18 from below.

A projecting end 29 of the engaging projection 28 is pointed up towards the engageable surface 18A. An upper surface 28A of the engaging projection 28 facing the engageable surface 18A has substantially the same inclination as the engageable surface 18A. A vertical clearance between the upper wall 13U of the receptacle 13 and the upper surface 21U of the female connector 20 is equal to a vertical clearance between the engageable portions 18 and the engaging projections 28 when the two connectors 10, 20 are connected properly.

The female connector 20 is connected along the connecting direction CD with the male connector 10 mounted on the circuit board K. More particularly, the female connector 20 is inserted gradually into the receptacle 13 with the upper and lower reinforcing ribs 17U, 17S of the receptacle 13 oriented to fit in the upper and lower receiving grooves 27U, 27S of the female connector 20. Thus, the front ends of the upper reinforcing ribs 17U enter the front ends of the corresponding upper receiving grooves 27U and the front ends of the lower reinforcing ribs 17S enter the front ends of the corresponding lower receiving grooves 27S. At this time, the front ends of the engaging projections 28 in the lower receiving grooves 27S enter the recesses 19 below the engageable portions 18 of the lower reinforcing ribs 17S.

The upper and lower reinforcing ribs 17U, 17S and the upper and lower receiving grooves 27U, 27S engage more deeply as the female connector 20 is inserted further. The lock arm 26 engages the lock projection 15 when the two connectors 10, 20 reach proper connection positions to hold the two connectors 10, 20 together. At this time, the upper and lower reinforcing ribs 17U, 17S and the upper and lower receiving grooves 27U, 27S are engaged over substantially the entire lengths in forward and backward directions. Additionally, all of the engaging projections 28 are located below the engageable portions 18 over substantially the entire lengths in forward and backward directions and contact the engageable portions 18 from below.

At this time, the vertical clearance between the upper surface 21U of the female connector 20 and the upper wall 13U of the receptacle 13 equals the vertical clearance between the engageable surfaces 18A of the engageable portions 18 and the upper surfaces 28A of the engaging projections 28.

An upward force may act on the housing 21, for example, if the wire W drawn out backward from the housing 21 of the female connector 20 is pulled up. As a result, the rear side of the housing 21 where the wire W is drawn out is displaced up. The upper surface 21U contacts the upper wall 13U when this displacement reaches an amount equal to the clearance between the upper surface 21U of the housing 21 and the upper wall 13U of the receptacle 13 and simultaneously the engaging projections 28 contact the engageable portions 18 (see FIG. 4). Here, the projecting ends 29 of the engaging projection 28 engage and bite into the engageable portions 18 if the force pulling the wire W is strong. The upward force on the engageable portions 18 is borne by the upper wall 13S via the lower reinforcing ribs 17S so that the upward force acting on the housing 21 is borne simultaneously by the upper and lower walls 13U, 13S of the receptacle 13.

A plurality engageable portions 18 and a plurality of engaging projections 28 are arranged side by side in the width direction WD of the board connector C1. Thus, even if the upward force acts disproportionally in the width direction WD of the female connector 20, any one of the plurality of pairs of engageable portions 18 and engaging projections 28 are engaged to prevent the force from acting only on the upper wall 13U of the receptacle 13.

The upward force on the female connector 20 is borne by both the upper wall 13U of the receptacle 13 and the lower wall 13S. Thus, the upper wall 13U can be thinner as compared to the case where this force acts only on the upper wall 13U. As a result, the board connector C1 can be thinned further.

As described above, the engaging projections 28 projecting from the surfaces of the lower receiving grooves 27S are inserted below the engageable portions 18 of the lower reinforcing ribs 17S and can contact the engageable portions 18 from below when the two connectors 10, 20 are connected properly. An upward force on the female connector 20 causes the engaging projections 28 to contact the engageable portions 18 so that the force is borne by the lower reinforcing ribs 17S. In other words, the upward force on the female connector 20 is borne by both the upper and lower walls 13U and 13S of the receptacle 13, and the upper wall 13U can thinner than if the this force acts only on the upper wall 13U. As a result, the board connector C1 can be thinned further.

Further, the upward force on the female connector 20 is borne simultaneously by the upper and lower walls 13U, 13S. Accordingly, a situation where the upward force is borne only by one of the upper and lower walls 13U, 13S of the receptacle 13 does not occur, and it is not necessary to determine the thicknesses of the both walls, presuming that such a situation may occur even temporarily. Therefore, the upper and lower walls 13U, 13S can be made even thinner to permit the thinning of the board connector C1.

The engageable portions 18 and the engaging projections 28 project laterally at a substantially right angle with respect to the connecting direction CD of the two connectors 10, 20 and the lower reinforcing ribs 17S and the lower receiving grooves 27S are formed over at least part, preferably over more than about half the length in the connecting direction CD, most preferably over the substantially entire lengths in the connecting direction CD of the two connectors 10, 20. Thus, the upward force on the female connector 20 is distributed over the lower reinforcing ribs 17S in forward and backward directions. In other words, since the upward force is borne by the lower wall 13S while being distributed in forward and backward directions, the lower wall 13S can be made thinner as compared to the case where this force concentrates at a specific part of the lower wall 13S in forward and backward directions.

Further, the engageable surfaces 18A of the engageable portions 18 are inclined to approach the lower wall 13S toward the projecting ends of the engageable portions 18. Thus, the engageable surfaces 18A are unlikely to disengage laterally from the engaging projections 28 held in contact with the engageable surfaces 18A and the state where the upward force is borne by the lower wall 13S is maintained reliably.

The projecting ends 29 of the engaging projections 28 are pointed up towards the engageable surfaces 18A. Thus, a large upward force on the female connector 20 will cause the projecting ends of the engaging projections 28 to bite in and penetrate the engageable portions 18. Accordingly, the engaging projections 28 are unlikely to disengage from the engageable portions 18 and the upward force is borne reliably by the lower wall 13S to prevent a situation where the engaging projections 28 and the engageable portions 18 inadvertently disengage so that a potentially damaging upward force acts only to the upper wall 13U.

Figure 6:
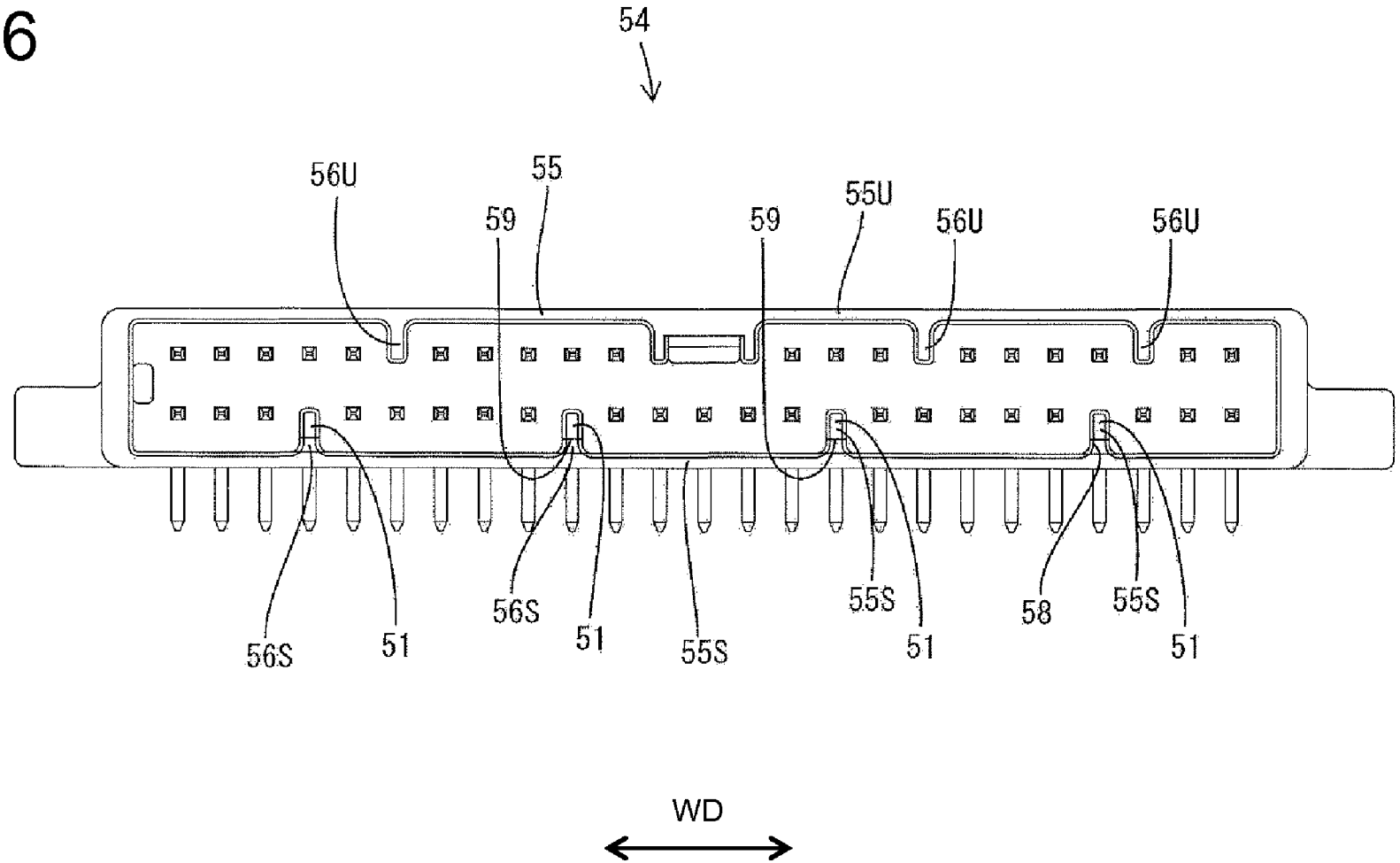
FIG. 6 is a front view of a male connector.
Figure 7:
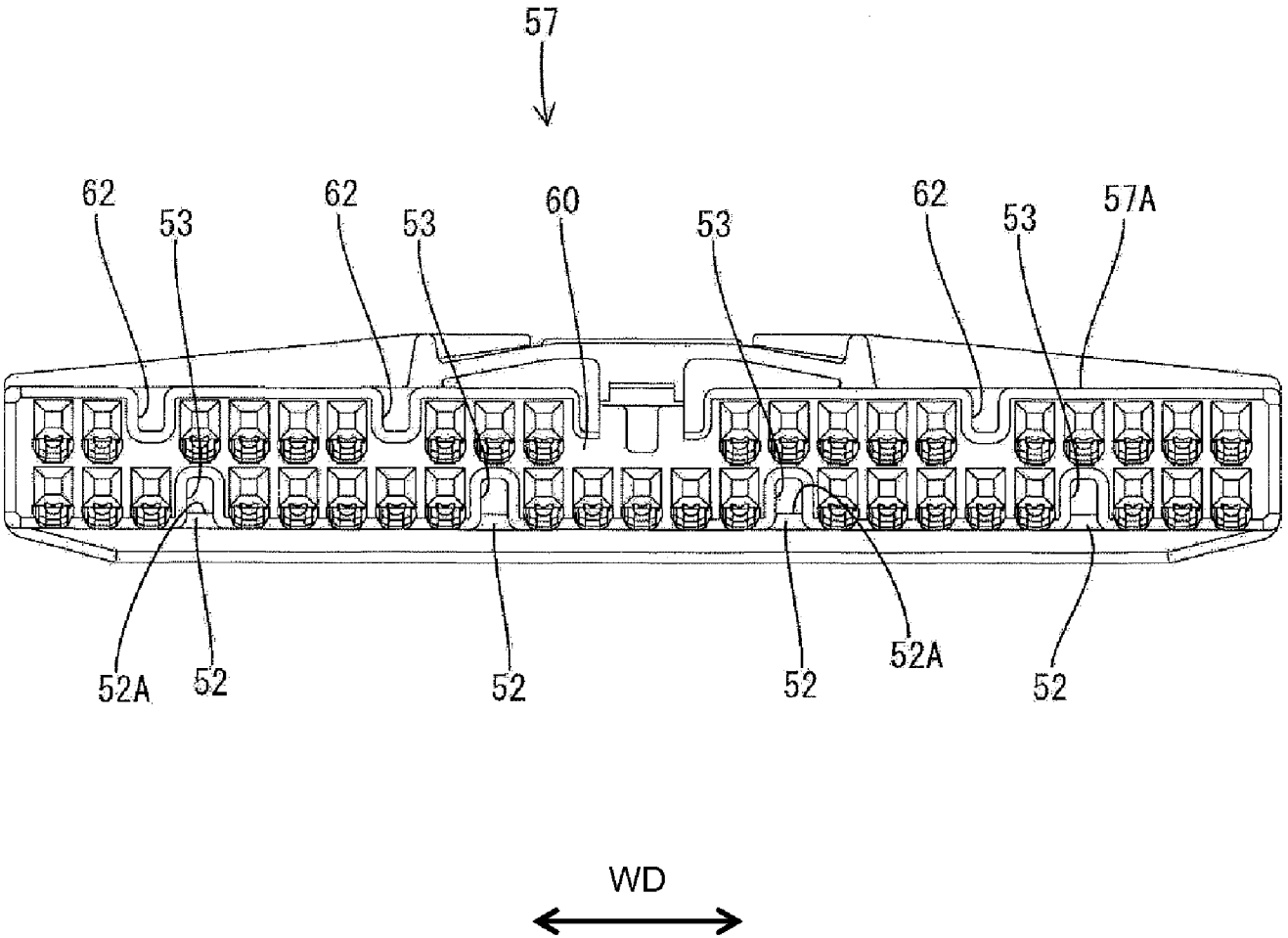
FIG. 7 is a front view of a female connector.

A board connector C2 according to a second embodiment of the invention is described with reference to FIGS. 5 to 7. The board connector C2 has lower reinforcing ribs 56S with engageable portions 51 and lower receiving grooves 53 with engaging projections 52. However, unlike the first embodiment, the engageable portions 51 and engaging projections 52 of the board connector C2 do not extend over the entire lengths of the lower reinforcing ribs 56S and lower receiving grooves 53. Rather, the engageable portions 51 are provided only at the front ends of lower reinforcing ribs 56S and the engaging projections 52 are provided only at the rear ends of lower receiving grooves 53. Elements of the second embodiment that are the same as or similar to the first embodiment are identified by the same reference numerals but are not described again.

Similar to the first embodiment, the board connector C2 has a male connector 54 with a receptacle 55. Upper and lower walls 55U and 55S of the receptacle 55 are thinned, and the upper and lower reinforcing ribs 56U, 56S are provided for reinforcement (see FIG. 6).

Figure 5:
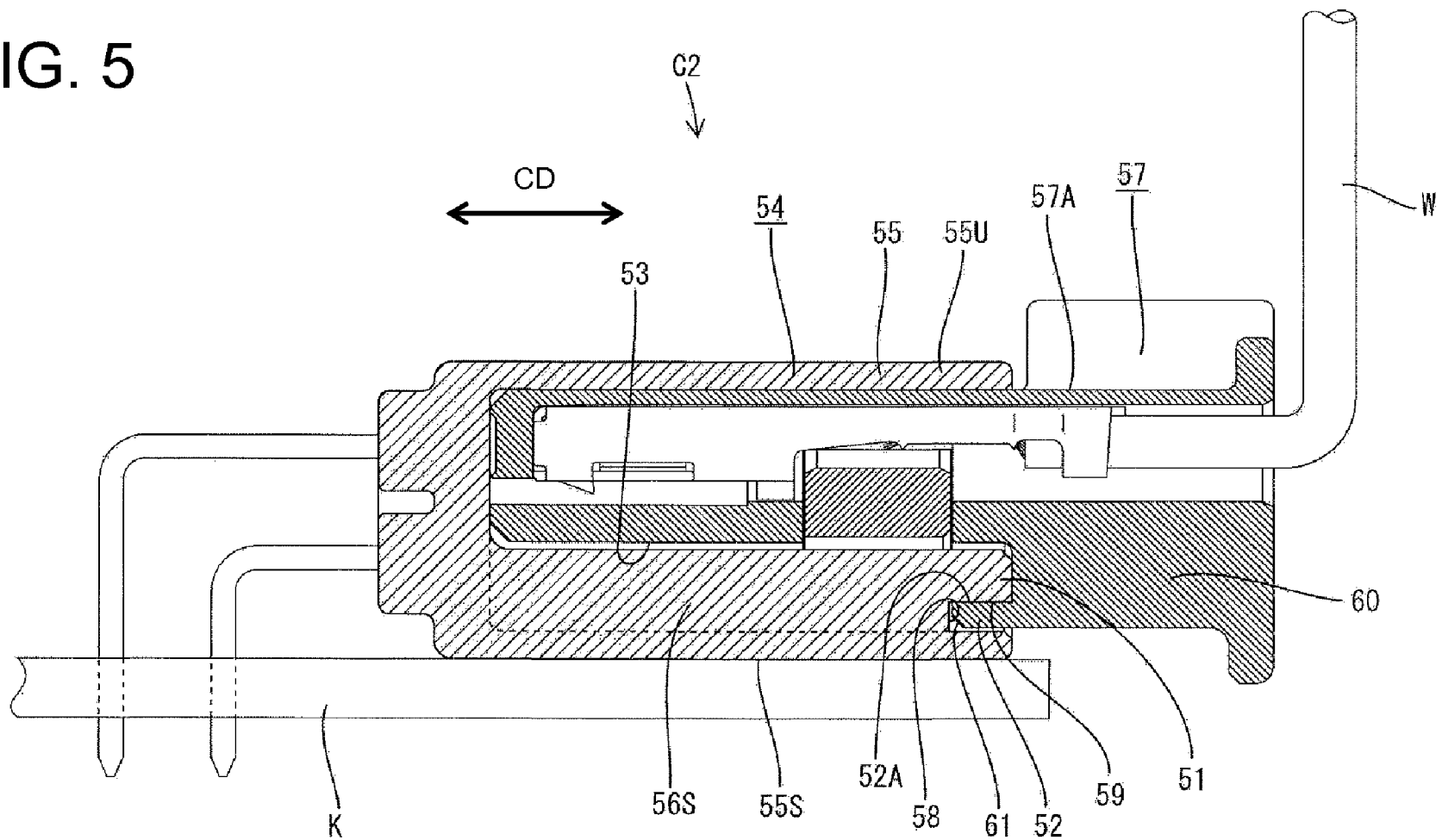
FIG. 5 is a side view in section of a board connector according to a second embodiment.

As shown in FIG. 5, an engageable portion 51 projects forward from an upper part of the front end of each lower reinforcing rib 56S and is spaced up a specified distance from the lower wall 55S. A recess 58 is defined below the engageable portion 51 and is recessed backward by the projecting distance of the engageable portion 51. The engageable portions 51 of the lower reinforcing ribs 56S are formed over substantially the entire widths of the lower reinforcing ribs 56S and have engageable surfaces 59 that face the lower wall 55S. The engageable surfaces 59 are substantially flat and parallel to the lower wall 55S and are spaced a specified distance from the lower wall 55S.

On the other hand, the engaging projections 52 project forward in the connecting direction CD with the male connector 54 from the rear wall surfaces of the lower receiving grooves 53 and are insertable into the recesses 58 below the engageable portions 51.

The engaging projections 52 inserted below the engageable portions 51 can contact the engageable portions 51 from below when the two connectors 54, 57 are connected properly. Further, upper surfaces 52A of the engaging projections 52 facing the engageable surfaces 59A hare substantially flat and substantially parallel to the engageable surfaces 59. A guiding surface 61 is formed at a lower edge of the front end of the engaging projection 52 and is inclined to reduce the vertical thickness of the front projecting end of each engaging projection 52 towards the front.

A vertical clearance between the upper wall 55U of the receptacle 55 and an upper surface 57A of the female connector 57 equals the vertical clearance between the engageable portions 51 and the engaging projections 52.

Upon connecting the female connector 57 with the male connector 54 mounted on the circuit board K, the female connector 57 is inserted gradually into the receptacle 55 with the upper and lower reinforcing ribs 56U, 56S of the receptacle 55 oriented to fit in the upper and lower receiving grooves 62, 53 of the female connector 57. Then, the front ends of the respective upper reinforcing ribs 56U are received in the front ends of the corresponding upper receiving grooves 62 and the front ends of the lower reinforcing ribs 56S are received in the front ends of the corresponding lower receiving grooves 53.

The lower reinforcing ribs 56S are accommodated substantially completely in the lower receiving grooves 53 and the engaging projections 52 are inserted below the engageable portions 51 at a final stage of the connecting operation of the two connectors 54, 57. At this time, the guiding surfaces 61 at the front ends of the engaging projections 52 are guided forward without catching the upper edge of the lower wall 55S so that the engaging projections 52 smoothly enter the recesses 58. The upper and lower reinforcing ribs 56U, 56S and the upper and lower receiving grooves 62, 53 are engaged over substantially their entire lengths in the connecting direction CD when the two connectors 54, 57 reach proper connection positions. Therefore, the engaging projections 52 are below the engageable portions 51 and can contact the engageable portions 51 from below. At this time, the clearance between the upper surface 57A of the female connector 57 and the upper wall 55U of the receptacle 55 is substantially equal to that between the engageable portions 51 and the engaging projections 52.

An upward force may act on the housing 60, for example, if a wire W drawn out backward from the housing 60 of the female connector 57 is pulled up. Thus, the housing 60 is displaced up as in the first embodiment and the engaging projections 52 contact the engageable portions 51 substantially when the upper surface of the housing 60 contacts the upper wall 55U of the receptacle 55. The upward force on the housing 60 is borne substantially simultaneously by the upper and lower walls 55U, 55S of the receptacle 55.

As described above, in this embodiment, the upward force acting on the female connector 57 is borne by both the upper and lower walls 55U and 55S as in the first embodiment. Thus, the upper wall 55U can be made thinner as compared to the case where this force acts only on the upper wall 55U, and the entire receptacle 55 can be thinned.

The engageable portions 51 are formed over the entire widths of the lower reinforcing ribs 56S and the engageable portions 51 and the engaging projections 52 are held in surface contact. Thus, a force does not act disproportionally in the width direction, and the engaging projections 52 are unlikely to be displaced laterally from the engageable portions 51.

The engaging projections 52 and the engageable portions 51 are engaged at the final stage of the connecting operation of the two connectors 54, 57. Thus, there is no likelihood of increasing a resistance force due to the contact of the engaging projections 52 and the engageable portions 51 from the initial stage to the final stage of the connecting operation of the two connectors 54, 57. As a result, a force required to connect the two connectors 54, 57 is suppressed to about the same level as in the case where neither the engaging projections 52 nor the engageable portions 51 are provided.

The more guiding surfaces 61 are formed at the lower edges of the front ends of the engaging projections 52. Thus, the front ends of the engaging projections 52 are unlikely to get caught by the lower wall 55S and the two connectors 54, 57 can be connected smoothly.

The invention is not limited to the above described and illustrated embodiment. For example, the following embodiments are also embraced by the technical scope of the present invention as defined by the claims.

The lower reinforcing ribs 17S have the engageable portions 18 projecting toward one lateral side and are substantially L-shaped when viewed from front in the first embodiment. However, the invention is not limited thereto and the lower reinforcing ribs 17S may have engageable portions projecting towards opposite lateral sides e.g. to be substantially T-shaped when viewed from the front.

The engageable portions 18 and the engaging projections 28 are provided over the entire lengths of the lower reinforcing ribs 17S and the lower receiving grooves 27S in the first embodiment. However, they need not be formed over the entire lengths.

The engageable surfaces 18A are inclined to approach the lower wall 13S toward the projecting ends of the engageable portions 18 in the first embodiment. However, the invention is not limited thereto and the engageable surfaces 18A may be substantially parallel to the lower wall.

Although the projecting ends 29 of the engaging projections 28 have the pointed shape in the first embodiment, they need not be pointed.

The guiding surfaces 61 are formed at the front ends of the engaging projections 52 in the second embodiment. However, the invention is not limited to this and the guiding surfaces may not be formed although the engaging projections may be more likely to get caught by the receptacle 13.

The clearance between the upper surface of the female connector 20 and the upper wall 13U of the receptacle 13 preferably is substantially equal to that between the engageable portions 18, 51 and the engaging projections 28, 52 in the above embodiments. However, the invention is not so limited and the two clearances need not be equal as long as these clearances are formed such that, even if the female connector first comes into contact with either one of the upper and lower walls of the receptacle, it immediately comes into contact with the other wall.

What is claimed is:

1. A connector to be mounted to an electric or electronic device, comprising:

a first connector having opposite front and rear ends spaced apart along a connecting direction, a receptacle having an opening at the front end of the first connector, a lower wall extending parallel to the connecting direction, the lower wall having an inner surface facing into the receptacle and an outer surface mountable to the electric or electronic device, opposed side walls projecting up from the lower wall and a top wall opposed to the lower wall, at least one reinforcing rib projecting into the receptacle from the inner surface of the lower wall and extending substantially along the connecting direction for reinforcing the lower wall, the reinforcing rib being spaced inwardly from the side walls, at least one engageable portion projecting from the reinforcing rib and substantially facing the lower wall at a position spaced from the lower wall and spaced from the side walls; and a second connector fittable into the receptacle and having a lower surface arrangeable to face the lower wall of the receptacle, the lower surface having at least one receiving groove extending along the connecting direction for receiving the reinforcing rib upon connecting the first and second connectors, and at least one engaging projection projecting into the receiving groove at a position for contacting the engageable portion at positions between the engageable portion and the lower wall when the connectors are connected properly.

2. The connector of claim 1, wherein a vertical clearance between an upper wall of the receptacle and an upper surface of the second connector substantially equals a distance between the engageable portion and the engaging projection.

3. The connector of claim 1, wherein the engageable portion and the engaging projection project at an angle to the connecting direction of the two connectors.

4. The connector of claim 1, wherein the engageable portion and the engaging projection are formed over substantially entire lengths of the reinforcing rib and the receiving groove in the connecting direction of the two connectors(10, 20; 54, 57).

5. The connector of claim 1, wherein the engageable portion is provided on a front part of the reinforcing rib in the connecting direction with the second connector, and the engaging projection is provided on a rear part of the receiving groove in the connecting direction with the first connector.

6. The connector of claim 1, wherein at least one guiding surface is formed at a projecting end of the engaging projection and is inclined to reduce a vertical thickness of the projecting end of the engaging projection towards the front in the connecting direction with the first connector.

7. The connector of claim 1, wherein the at least one reinforcing rib comprises a plurality of reinforcing ribs, each of the reinforcing ribs extending substantially along the connecting direction and being spaced from one another and spaced inwardly from the side walls of the receptacle.

8. The connector of claim 1, wherein an engageable surface of the engageable portion substantially facing the engaging projection is inclined to approach the lower wall towards a projecting end of the engageable portion.

9. The connector of claim 8, wherein the projecting end of the engaging projection is pointed towards an engageable surface of the engageable portion.

* * * * *